US012650006B2

(12) United States Patent
Krone et al.

(10) Patent No.: US 12,650,006 B2
(45) Date of Patent: Jun. 9, 2026

(54) CONTROL SYSTEM FOR OPERATING A MOBILE MACHINE WITH A RIPPER

(71) Applicant: Caterpillar Inc., Peoria, IL (US)

(72) Inventors: Bradley P. Krone, Dunlap, IL (US); Christopher M. Gerth, Chillicothe, IL (US); Kristopher Kyarsgaard, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 130 days.

(21) Appl. No.: 18/394,295

(22) Filed: Dec. 22, 2023

(65) Prior Publication Data

US 2025/0207370 A1 Jun. 26, 2025

(51) Int. Cl.

| | |
|---|---|
| ***E02F 9/26*** | (2006.01) |
| ***E02F 5/32*** | (2006.01) |
| ***E02F 9/20*** | (2006.01) |
| ***E02F 9/22*** | (2006.01) |

(52) U.S. Cl.

CPC ..... *E02F 9/268* (2013.01); *E02F 9/265* (2013.01); *E02F 5/32* (2013.01); *E02F 9/2083* (2013.01); *E02F 9/2203* (2013.01)

(58) Field of Classification Search

CPC ... E02F 9/268; E02F 9/265; E02F 5/32; E02F 9/2083; E02F 9/2203

USPC ..... 701/50

See application file for complete search history.

(56) References Cited

U.S. PATENT DOCUMENTS

| | | | | |
|---|---|---|---|---|
| 4,031,964 | A | 6/1977 | Takahashi et al. | |
| 4,062,539 | A | 12/1977 | Tetsuka et al. | |
| 4,798,099 | A * | 1/1989 | Alexander | F16H 59/02 74/484 R |
| 5,293,944 | A | 3/1994 | Matsumoto | |
| 5,685,377 | A * | 11/1997 | Arstein | E02F 9/2041 172/699 |
| 6,278,955 | B1 | 8/2001 | Hartman et al. | |
| 6,317,676 | B1 | 11/2001 | Gengler et al. | |
| 8,083,004 | B2 | 12/2011 | Knight, Jr. | |
| 8,616,297 | B2 | 12/2013 | Shintani et al. | |
| 8,788,157 | B2 | 7/2014 | Shintani et al. | |
| 9,033,062 | B2 | 5/2015 | Stratton et al. | |
| 9,292,813 | B2 | 3/2016 | Tucker et al. | |
| 9,435,102 | B2 | 9/2016 | Hall | |
| 9,624,650 | B2 | 4/2017 | Stratton | |
| 10,246,087 | B2 | 4/2019 | Mitchell et al. | |
| 10,518,637 | B2 | 12/2019 | Uemura et al. | |
| 11,215,781 | B1 | 1/2022 | Pino, Jr. | |

(Continued)

FOREIGN PATENT DOCUMENTS

| | | | |
|---|---|---|---|
| CN | 105002943 | A | 10/2015 |
| CN | 109797793 | B | 7/2021 |

(Continued)

*Primary Examiner* — Helal A Algahaim
*Assistant Examiner* — Leah N Miller

(57) ABSTRACT

A mobile machine with a ripper attached is configured with a control system to conduct a ripping operation. Prior to the ripping operation and travel of the mobile machine, the control system may receive an initiation event. The control system may also determine a riper configuration using ripper configuration sensors. If the control system determines the riper configuration indicates the ripper tip contacts a support surface, the control system can take one or more prevention actions to prevent the ripping operation.

18 Claims, 4 Drawing Sheets

(56) References Cited

U.S. PATENT DOCUMENTS

| | | | | |
|---|---|---|---|---|
| 2012/0073843 | A1 | 3/2012 | Kure | |
| 2012/0267128 | A1* | 10/2012 | Shintani | E02F 9/26 172/1 |
| 2012/0318541 | A1 | 12/2012 | Sulzer | |
| 2015/0014003 | A1* | 1/2015 | Stratton | E02F 3/7604 701/50 |
| 2017/0030052 | A1 | 2/2017 | Wei et al. | |
| 2017/0204588 | A1 | 7/2017 | Faivre et al. | |
| 2018/0202131 | A1* | 7/2018 | Tsukamoto | H04N 7/181 |
| 2022/0316173 | A1 | 10/2022 | Narikawa et al. | |

FOREIGN PATENT DOCUMENTS

| | | | | | |
|---|---|---|---|---|---|
| CN | 107313475 | B | * | 2/2023 | E02F 3/7604 |
| JP | H0762683 | A | * | 3/1995 | |
| JP | 2013-217057 | A | | 10/2013 | |
| KR | 20150061822 | A | | 6/2015 | |
| KR | 102252607 | B1 | | 5/2021 | |
| WO | WO 2022/239296 | A1 | | 11/2022 | |

* cited by examiner

CONTROL SYSTEM FOR OPERATING A MOBILE MACHINE WITH A RIPPER

TECHNICAL FIELD

This patent disclosure relates generally to controlling operation of a mobile machine equipped with a ripper tool and, more particularly, to a control system and method associated with initiating a ripping operation.

BACKGROUND

Mobile excavation machines such as dozers, agricultural tractors, and motor graders may include one or more material engaging implements utilized to cultivate, dig, rip or otherwise disturb a ground surface. A ripping tool or ripper is an example of an implement that can be attached to a mobile machine and operated to penetrate into the terrain surface. As the mobile machine travels over the terrain surface, the ripper digs through and displaces the terrain substrate preparing it for subsequent operations.

To move the ripper with respect to the mobile machine, the ripper may be operatively associated with a hydraulic lift actuator and a hydraulic tilt actuator. The lift actuator can vertically raise and lower the ripper with respect to the terrain surface and the tilt actuator can angularly tilt the ripper to change the direction of a ripper tip with respect to the terrain surface, for example, to penetrate the terrain surface or to displace the underlying terrain substrate. When the mobile machine is not conducting a ripping operation, however, the ripper may be positioned to rest the ripper tip on a support surface and allow for deactivation, e.g., depressurization, of the lift and tilt actuators.

U.S. Pat. No. 9,033,062 describes a control system that includes a ripper sensor associated with a ripper that generates a signal indicative of the position of the ripper. The system also includes a steering command sensor configured to generate a signal indicative of a steering command for the machine. A controller is configured to receive the signals indicative of the position of the ripper and the steering command and can execute an action based on the engaged state of the ripper and the steering command.

The present disclosure solves one or more problems set forth above and/or other problems in the art.

SUMMARY

The disclosure describes, in one aspect, a control system for a mobile machine with a ripper attached thereto. The control system is associated with an initiation detector to detect an initiation event prior to travel of a mobile machine. The control system is also associated with a ripper configuration sensor associated with the ripper. An electronic controller of the control system communicates with the initiation detector and with the ripper configuration sensor. The electronic controller is configured such that, in response to detecting an initiation event, the control system determines if a ripper tip attached to the ripper contacts a support surface. Based on determining the ripper tip does contact the support surface, the control system executes a ripping prevention action prior to travel of the mobile machine to avoid unintentional damage from the ripper.

In another aspect, the disclosure describes a method of controlling a mobile machine with an attached ripper. The method detects an initiation event prior to travel of the mobile machine and senses a ripper configuration of the ripper with a ripper configuration sensor. In accordance with the method, if it is determined from the ripper configuration that the ripper tip contacts a support surface, a ripping prevention action is executed prior to travel of the mobile machine to prevent the ripper from causing damage.

In yet another aspect, the disclosure describes a mobile machine including a machine chassis with a plurality of traction devices for traveling over a terrain surface. Attached to a chassis of the mobile machine is a ripper. The mobile machine also includes an initiation detector to detect an initiation event prior to travel of a mobile machine and a ripper configuration sensor associated with the ripper to sense if the ripper tip contacts the terrain surface. An electronic controller of the mobile machine is in communication with the event detector and the ripper configuration sensor. If the ripper configuration sensor detects that the ripper tip contacts the terrain surface, the electronic controller executes a ripping prevention action prior to travel of the mobile machine to prevent the ripping operation.

DETAILED DESCRIPTION

Figure 1:
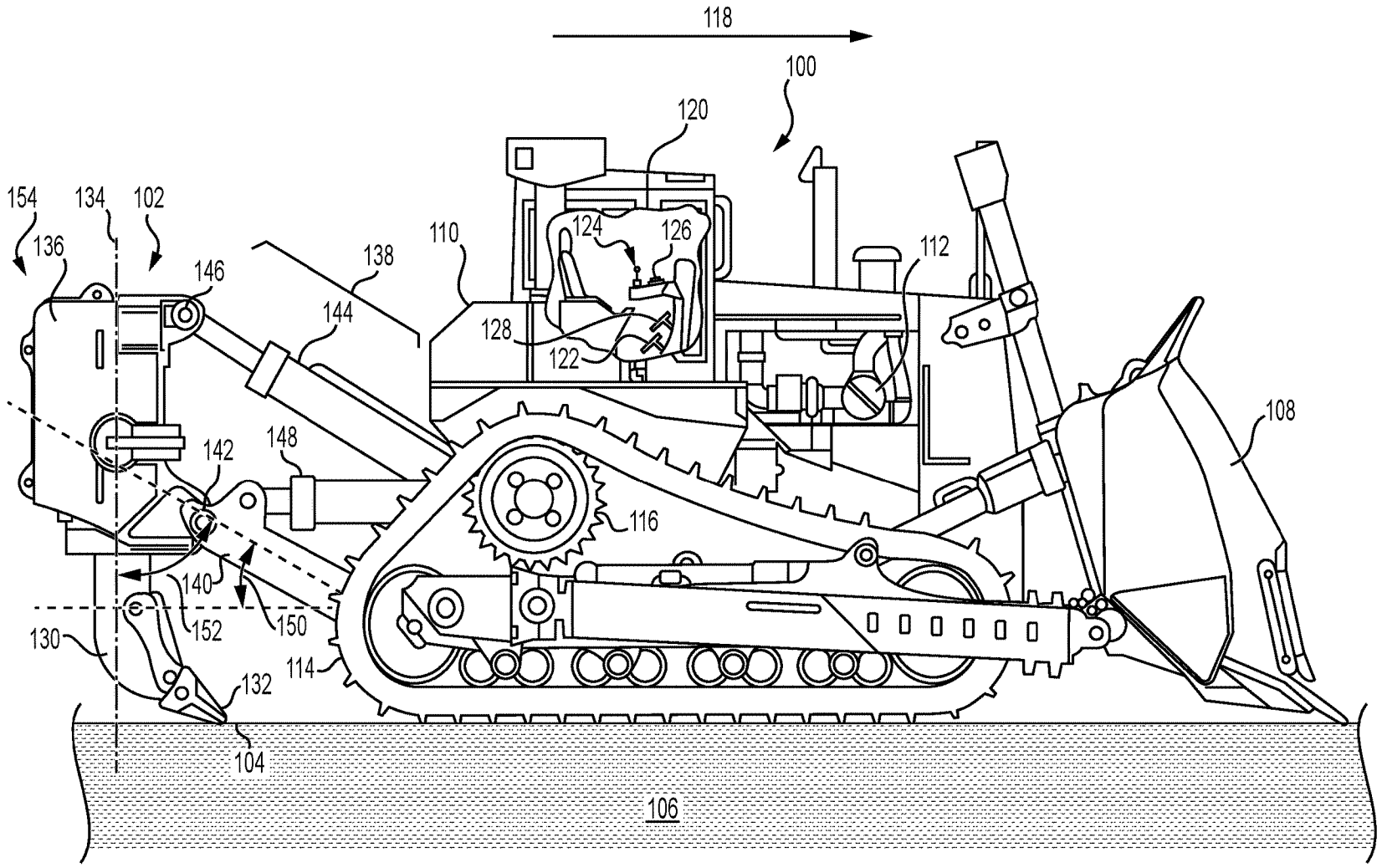
FIG. 1 is a schematic side view of an exemplary mobile machine equipped with a ripper for conducting a ripping operation on a terrain surface in accordance with an embodiment of the disclosure.

Now referring to the drawings, wherein whenever possible like reference numbers will refer to like elements, there is illustrated in FIG. 1 a mobile machine 100 equipped with a ripper 102 situated on a terrain surface 104. The terrain surface 104 can be located at a worksite associated with various industries such as mining, agriculture, construction, forestry, waste management, and material handling, among others. The mobile machine 100 may be an earth moving machine such as a motor grader, a dozer, a loader, a backhoe, an excavator, or any other type of earth moving machine. The machine 100 may traverse a work site to manipulate the terrain surface 104 and the terrain substrate 106 beneath the surface, e.g. transport, cultivate, dig, rip, and/or execute any other operation known in the art. In the illustrated embodiment, the mobile machine 100 is a track type dozer.

In the embodiment of a dozer, the mobile machine 100 can include a ground-engaging implement such as a blade 108 configured to push material over the terrain surface 104. The blade 108 can be hingedly attached to the forward end of a frame or machine chassis 110 so that the blade can be elevated above or lowered to contact the terrain surface 104. The mobile machine 100 can also be operably associated with any other suitable work implement for conducting various operations.

To propel the mobile machine 100 over the terrain surface 104, the mobile machine is equipped with a power source 112 configured to produce mechanical power. The power source 112 can be any type of internal combustion engine such as, for example, a diesel engine, a gasoline engine or a gaseous fuel powered engine. The power source 112 can combust the hydrocarbon-based fuel to convert the chemical energy therein to mechanical motive power and rotational torque. Further, the power source 112 can also be a non-engine power producing device such as, for example, a fuel cell, a battery, a motor, or another type of power source known in the art.

The mobile machine 100 can be supported on traction/propulsion devices 114 movable with respect to the machine chassis 110 and located on each side. In the illustrated embodiment, the traction/propulsion devices 114 can be continuous tracks that are operably driven by one or more sprockets 116. The sprockets 116 are operatively connected with the power source 112 through an intermediate group of components referred to as a drivetrain to receive motive power and drive the traction/propulsion devices 114. Translation of the traction/propulsion devices 114 with respect to the machine chassis 110 propels the mobile machine 100 over the terrain surface 104 along a travel direction 118. The traction/propulsion devices 114 can be translated so as to propel the mobile machine 100 in either direction with respect to the travel direction 118, i.e., in forward or reverse. Further, relative translation of the traction/propulsion devices 114 can cause a steering change in the travel direction 118, thus steering the mobile machine 100. In addition to continuous tracks, the traction/propulsion devices 114 may also be wheels, belts, or other devices. Furthermore, the traction/propulsion devices 114 may be driven hydraulically, mechanically, electrically by motor, or actuated in any other manner.

To accommodate an operator, the mobile machine 100 can include an operator station 120 located on top of the machine chassis 110 to provide visibility over the terrain surface 104. The operator station 120 can accommodate different controls for operation of the mobile machine 100. For example, to control the travel speed and velocity of the mobile machine 100 by adjusting the motive output of the power source 112, a deceleration pedal 122 can be located in the operator station 120 that operates by adjusting the quantity and/or timing of fuel injections or air introduced to the power source 112. Depressing the deceleration pedal 122 may reduce the travel speed of the mobile machine 100 in the travel direction 118 and releasing the deceleration pedal may increase the travel speed. To alter the travel direction 118, the operator station 120 can include a steering control 124 embodied as a joystick that can be manipulated by hand to steer the mobile machine 100. In additional to a joystick, the steering control 124 may be a conventional steering wheel. Also included in the operator station 120 can be a transmission gear-shifter or a drive selector 126 operatively associated with the drivetrain to set the operating gear of the mobile machine 100, which may include forward, neutral, reverse, and/or park settings.

The operator station 120 can also include a parking brake 128 which be embodied as a pedal disposed proximate to the deceleration pedal 122. The parking brake 128 can be engaged to positively secure the mobile machine 100 from travel, for example, by locking translation of the traction/propulsion devices 114 by disabling or preventing the transfer of motive force through the drivetrain. The parking brake 128 may also be embodied as a hand-operated lever that can be actuated to engage the brake. The operator station 120 can also include controls for operating the ripper 102 as described below.

In accordance with the disclosure, the mobile machine 100 can be operated manually, autonomously, or semi-autonomously. During manual operation, an operator controls and directs essentially all the functions and activities of the machine using the controls in the operator station 120 described above. Manual operation may also occur remotely wherein the operator is located off board the mobile machine 100 and operation is controlled through a remote control and wireless communication techniques.

In autonomous operation, the mobile machine 100 can operate responsively to information about the operating and environmental conditions provided from various sensors by selecting and executing various predetermined responses to the received information. In semi-autonomous operation, an operator either onboard or working remotely may perform some tasks and functions while others are conduced automatically in response to information received from sensors.

In any of the foregoing embodiments, to conduct a ripping operation with the mobile machine 100, the ripping tool or ripper 102 attached to rear of the machine chassis 110 is structurally configured with a curvature and tapper to penetrate into terrain surface 104 and displace a portion of the terrain substrate 106. The ripper 102 includes a ripper shank 130, which may be straight or slightly curved length of structural steel, and ripper tip 132 attached at the distal end of the shank. The ripper shank 130 defines a shank axis 134 and the ripper tip 132 can be disposed at an angle to the shank axis 134 to provide a curvature to the shape of the ripper 102 that facilities pentation and displacement of the terrain surface 104 and terrain substrate 106. The ripper tip 132 can be detached from the ripper shank 130 to allow different ripper tip configurations to be interchangeably used with the ripper 102 for different terrain materials and ripping operations.

To hold and attach the ripper shank 130 to the machine chassis 110, the ripper 102 includes a mounting member 136 connected with the machine chassis 110 via a mounting frame 138. The mounting member 136 can have a block-like steel structure with a central bore into which the straight portion of the ripper shank 130 can be inserted and secured. The shank axis 134 is therefore spatially fixed with respect to the block-like structure of the mounting member 136. Insertion of the ripper shank 130 into the mounting member 136 can be adjustable so that the distance the ripper shank extends therefrom can be changed to accommodate different configurations and/or sizes of the machine chassis 110 to which it is connected.

The mounting frame 138 may be configured to move the mounting member 136 and the ripper shank 130 retained therein to positions that are vertically higher, vertically lower, away from or forward towards the machine chassis 110. To move the mounting member 136 and ripper shank 130, the mounting frame 138 is configured as a linkage assembled of rigid links and pivoting joints that articulate with respect to each other. In an embodiment, the mounting frame 138 may be a multiple bar parallelogram that allows constrained motion of the shank axis 134 vertically and parallel with respect to, for example, the terrain surface 104.

The mounting frame 138 can include a rigid mounting link 140 that is pivotally connected to the mounting member 136 and that is connectively linked to the machine chassis 110 thereby spacing the structures apart from each other. In particular, the mounting link 140 connects to the bottom of the mounting member 136 at a first revolute joint or pivot joint 142 that enables relative rotation between the structures. Pivoting the mounting member 136 at the first pivot joint 142 changes or tilts the angular orientation of the shank axis 134 with respect to the machine chassis 110 and the terrain surface 104.

To tilt the shank axis 134, the mounting frame 138 can include a hydraulic tilt actuator 144 that extends between the machine chassis 110 and that is pivotally connected to the top of the mounting member 136 at a second revolute joint or pivot joint 146. Extension and retraction of the tilt actuator 144 pivots the mounting member 136 about the first pivot joint 142 where it connects to the mounting link 140. Pivoting the mounting member 136 also changes the angular orientation of the shank axis 134 that is constrained within the mounting member 136. To vertically raise and lower the mounting member 136 with respect to the machine chassis 110, a hydraulic lift actuator 148 is located between the structures and, in an embodiment, may be pivotally connected to machine chassis 110 and the mounting link 140. Actuation of the lift actuator 148 pivots the rigid mounting link 140 with respect to the machine chassis 110, which results in vertically raising or lowing the mounting member 136 to which the mounting link 140 is connected.

Per conventional design, the tilt and lift actuators 144, 148 can include a hollow cylinder body inside of which is located a reciprocally movable a piston attached to an elongated rod. The rod projects from and can extend and retract with respect to one end of the cylinder body when pressurized hydraulic fluid is introduced to or removed from the cylinder body. The mobile machine 100 can be equipped with a hydraulic system to supply pressurized hydraulic fluid to the tilt and lift actuators 144, 148.

The movable configuration of the mounting frame 138 produces distinct referential angles that change in degree or angular magnitudes in relation to movement of the ripper 102. For example, a mounting frame angle 150 may be defined where the machine chassis 110 is pivotally connected with the mounting link 140. The machine chassis 110 can be considered adjacent and parallel to the terrain surface 104 on which it is situated, and therefore may be parallel with the travel direction 118. The mounting frame angle 150, as defined by the horizontal machine chassis 110 and the mounting link 140 that extends from the machine chassis 110, can change by actuation of the lift actuator 148 thus vertically raising or lowering the ripper 102 with respect to the terrain surface 104.

The mounting frame 138 can also be associated with a shank axis angle 152 that may be defined by the orientation of the shank axis 134 with respect to the extension of the mounting link 140. Because extension and retraction of the tilt actuator 144 tilts the mounting member 136 and shank axis 134 about the first pivot joint 142, the tilt actuator 144 also can change the angular magnitude of the shank axis angle 152. Changing the shank axis angle 152 relatedly changes the angular orientation of the ripper shank 130 and the shank axis 134 with respect to the terrain surface 104.

Movement of the ripper 102 may correspond to a plurality of predetermined locations and/or orientations (i.e. angle settings of the ripper shank 130 and the associated shank axis 134). For example, the ripper shank 130 may have a discrete penetration angle and a discrete dig angle that may change based on material composition of the terrain surface 104, a size or capacity of the mobile machine 100, the configuration of the ripper shank 130 relative to the mounting member 136, and/or the configuration of the ripper tip 132. The operator can control the tilt and lift actuators 144, 148 to adjust the mounting frame angle 150 and/or the shank axis angle 152 during the ripper operation to move the ripper 102 into positions for conducting penetration or digging of the terrain surface 104.

In one example, to penetrate the terrain surface 104, the lift actuator 148 can be extended to vertically raise the ripper 102 and the ripper tip 134 above the terrain surface 104. Concurrently, the tilt actuator 144 can be retracted to tilt the shank axis 134 rearward, aft of the machine chassis 110, to direct or point the ripper tip 134 toward the terrain surface 104, which may be referred to as the desired penetration angle. The lift actuator 148 can be actuated to drive the ripper tip 134 into forcible contact with the terrain surface 104 to fracture and break apart the terrain material.

Extension of the lift actuator 148 can continue to vertically lower the ripper 102 so the ripper tip 132 penetrates into the terrain surface 104 to a desired digging depth in the terrain substrate 106. Vertically lowering the ripper 102 corresponds to decreasing the mounting frame angle 150, which may be reduced to zero degrees. The tilt actuator 144 can concurrently be extended to pivot the mounting member 136 and the shank axis 134 forward with respect to the machine chassis 110, thereby decreasing the shank axis angle 152. Decreasing the shank axis angle 152 corresponds with moving the ripper tip 132 forward toward the machine chassis 110 so that the ripper tip 132 aligns with the travel direction 118. To conduct the digging sequence of a ripping operation, the mobile machine 100 travels forward in the travel direction 118 concurrently moving the ripper tip 134 within the terrain substrate 106 to breakup and displace the terrain material.

When the mobile machine 100 is not conducting a ripping operation, and particularly when the mobile machine 100 is idle or inactive, the ripper 102 may be moved to a rest or stowed position 154 illustrated in FIG. 1. In the ripper stowed position 154, the mounting frame angle 150 and the shank axis angle 152 are set so that the shank axis 134 is oriented generally perpendicular or normal to the terrain surface 104 and the ripper tip 132 is vertically positioned in abutting contact with the terrain surface 104. In some cases, the ripper tip 132 can be rested in abutting contact against another surface, such as a curb or wooden block. An operator may manually actuate the tilt and lift actuators 144, 148 to move the ripper 102 to the stowed position 154 before idling or deactivating the mobile machine 100, or an autonomous system may automatically actuate the tilt and lift actuators 144, 148 appropriately at the conclusion of an automated operational sequence.

When the ripper 102 is in the stowed position 154, the weight of the ripper is transferred along the shank axis 134 to and support by the terrain surface 104. Since the lift and tilt actuators 144, 148 no longer need to support the weight of the ripper 102 when in the stowed position 154, the hydraulic actuators can be deactivated by draining the hydraulic fluid therefrom and relatedly releasing the hydraulic pressure therein. Depressurizing the hydraulic actuators releases the hydraulic pressure forces otherwise applied to the actuator fluid seals and may prolong seal life. The ripper stowed position 154 also eliminates the possibility that an elevated ripper 102 may unintentionally drop to the terrain surface 104 upon accidental depressurization of the lift and tilt actuators 144, 148 possibly causing damage to the mobile machine 100 and/or terrain surface 104.

Figure 2:
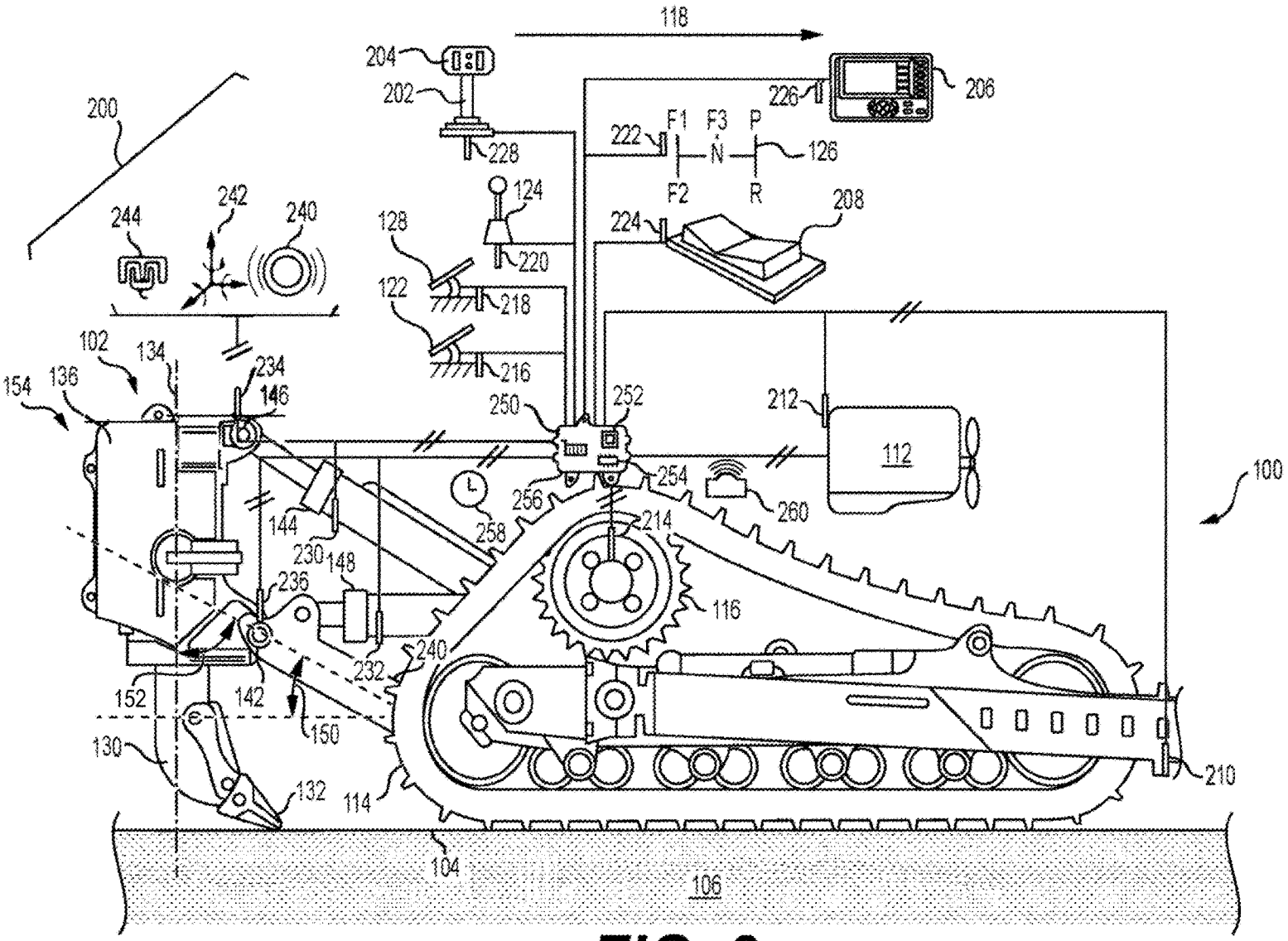
FIG. 2 is a schematic representation of the control system of the mobile machine that is configured to sense a configuration of the ripper with respect to the surface terrain prior to travel in accordance with some embodiments.

Referring to FIG. 2, there is illustrated the features and components of a control system 200 that can operatively monitor and control the spatial movements of the ripper 102 with respect to the mobile machine 100. For example, during manual operation of the mobile machine 100, the control system 200 can be operatively associated with controls and input/output devices to interface with an operator of the mobile machine 100. As described above with respect to the operator station 120, the control system 200 can be associated with the deceleration pedal 122 to control the travel speed and with the steering control 124 to change the travel direction 118 of the mobile machine 100. The control system 200 can also be associated with the drive selector 126 and with the parking brake 128 to determine whether the brake has been engaged to prevent motion of the mobile machine 100.

To enable the operator to control operation of the ripper 102, the control system 200 can also include a ripper control 202 that also may be located in the operator station 120. The ripper control 202 may allow the operator to adjust the vertical height of the ripper 102 above or below the terrain surface 104 and/or adjust the angle of the shank axis 134 with respect to the terrain surface 104 and the machine chassis 110 supported thereon. The ripper control 202 can operate by controlling the quantity or pressure of the hydraulic fluid supplied to or drained from the tilt actuator 144 and the lift actuator 148. The ripper control 202 may be embodied as a joystick or may be in the form of another suitable control apparatus known in the art. The ripper control 202 may also include one or more pushbuttons 204 that can be used to input, activate, or deactivate prearranged operational settings associated with the ripping operation. By way of example, the prearranged settings may correspond to a desired digging depth of the ripper tip 132 in the terrain substrate 106 and/or a desired digging angle of the shank axis 134 with respect to the terrain surface 104, which may be set in reference to the shank axis angle 152.

To interface with the operator, the control system 200 can include a human machine interface (HMI) that may be embodied as a visual display screen 206. The visual display screen 206 can visually present information to a human operator regarding operation of the mobile machine 100. The visual display screen 206 can be an organic light emitting diode display ("OLED"), or any suitable flat screen display capable of presenting numerical values, text descriptors, graphics, graphs, charts and the like regarding operation. The visual display screen 206 may have touch screen capabilities to receive input from a human operator, although in other embodiments, other interface devices may be included such as dials, knobs, switches, keypads, keyboards, mice, printers, etc.

In addition, in embodiments wherein the mobile machine 100 is configured for autonomous or semi-autonomous operation, or aspect of the ripping operation are automated, the control system 200 can be associated with an automatic setting switch 208 that can be embodied as a toggle switch. The operator can position the automatic setting switch 208 to activate automated operation of certain aspects of the mobile machine and can change the position the automatic setting switch to terminate automated operation of those activities. In addition, the operator may use other controls and/or input/output devices to override automated operation. For example, by manually manipulating the ripper control 202, the operator may assume active control over operation of the ripper 102 and terminate any automated settings or sequences.

To receive information about the current operating conditions and activities of the mobile machine 100, the control system 200 can be operatively associated with a plurality of sensors. The sensors may be any device for detecting or measuring a physical condition or change therein and outputting data representative of that occurrence. The sensors can work on any suitable operating principle for the assigned task, and may make mechanical, electrical, visual, and/or chemical measurements.

For example, to measure the travel speed or velocity of the mobile machine 100 with respect to the terrain surface 104, a ground sensor 210 can be located at a suitable location on the machine chassis 110. In an embodiment, the ground sensor 210 can be a reflective sensor that projects acoustic waves or radiofrequency waves toward the terrain surface 104 and detects the reflection back. The ground sensor 210 can therefore measure the true or actual speed or velocity of the mobile machine 100 over the terrain surface 104. The ground sensor 210 can also be a distance sensor and can measure the distance between a location on the machine c1hassis 110 and the surface terrain 104.

In another example, the ground speed sensor 210 can be operatively associated with a global navigation satellite system (GNSS) or global positioning satellite (GPS) system. In the GNSS or GPS system, a plurality of manmade satellites orbit about the earth at fixed or precise trajectories. Each satellite includes a positioning transmitter that transmits positioning signals encoding time and positioning information towards earth that can be received by receivers on the mobile machine 100. By calculating, such as by triangulation, between the positioning signals received by the machine receivers from different satellites, the control system 200 can determine their instantaneous location on earth and the relative travel speed of the mobile machine 100 with respect to the terrain surface 104.

To measure the performance or output of the power source 112, the control system 200 can be associated with one or more engine sensors 212. The engine sensors 212 can measure parameters or characteristics associated with the power source 112 such as motive output quantified in variables such as torque or revolutions per minute (RPM). The engine sensors 212 may also measure parameters reflecting combustion or efficiency, such as fuel or airflow rate into the engine, engine temperature, etc.

To measure utilization of the motive output from the power source 112, the control system 200 can be associated with a drivetrain sensor 214. For example, a drivetrain sensor 214 can be operatively associated with the traction/propulsion devices 114 and/or the drive sprocket 116. The drivetrain sensor 214 can be a rotary encoder that measures the revolutions made by the drive sprocket 116 to determine the driven travel speed of traction/propulsion devices 114. The translating speed of the traction/propulsion devices 114 reflects the commanded speed or velocity of the mobile machine 100, which may vary with respect to the true or actual speed of the mobile machine due to machine slippage.

The control system 200 can also be associated with command sensors or detectors configured to measure operational commands input through the operational input/output devices to initialize and control operation of the mobile machine. For example, a brake pedal detector 218 can be operatively associated with the brake pedal 128 to sense activation or deactivation of the parking brake and a deceleration pedal detector 216 can be operatively associate with the deceleration pedal 122 to sense depression or release of the deceleration pedal. To sense steering commands, a steering detector 220 can be operatively associated with and responsive to movement of the steering control 124. To sense the selected transmission gear or the commanded travel direction, a drive selection detector 222 can be operatively associated with the drive selector 126. To inform the control system 200 of the selected mode of operation for the mobile machine 100, an operational mode detector 224 is associated with the automatic setting switch 208 and is responsive to setting of that control. Likewise, to monitor the commands input through the HMI, a display detector 226 can be operatively associated with the visual display 206 corresponding to the HMI. Another example of a command sensor can be a ripper detector 228 associated with and responsive to movement of the ripper control 202.

To determine the present position and current movements of the ripper 102, the control system 200 can be associated with one or more ripper configuration sensors. In an embodiment, to determine the spatial position or geometric arrangement of the ripper 102, the ripper configuration sensors may be operatively associated with the hydraulic tilt and lift actuators 144, 148 and can be referred to a tilt actuator sensor 230 and a lift actuator sensor 232 respectively. The tilt and lift actuator sensors 230, 232 can be fluid pressure sensors or flowrate sensors that measure the hydraulic pressure in the tilt and lift actuators 144, 148 and/or the flow quantity of hydraulic fluid introduced to or drained from the lift and tilt actuators 144, 148.

In another embodiment, the tilt and lift actuator sensors 230, 232 can be travel sensors that measure the extension and retraction of the piston rods of the tilt and lift actuators 144, 148. The ripper position sensors may also be rotary encoders including a lift encoder 236 associated with the first pivot joint 142 and a tilt encoder 234 associated with the second pivot joint 146. The data output of the tilt and lift actuator sensor 230, 232 and/or the tilt and lift encoders 234, 236 can be referred to as kinematic ripper data representing the geometric positions of the lift and tilt actuators 144, 148, and thus the ripper 102, with respect to a reference, for example, the machine chassis.

Using dimensional data about the mounting frame 138 and the machine chassis 110, the control system 200 can apply kinematic equations to the kinematic ripper data output from tilt and lift actuator sensors 230, 232 and/or the tilt and lift encoders 234, 236 to calculate the position of the ripper 102 with respect to a reference such as the terrain surface 104. For example, the control system 200 can calculate the current geometric position of the ripper tip 132 with respect to the terrain surface 104 and in particular can sense if the ripper tip is in abutting contact with the terrain surface 104. The control system 200 can determine the spatial position of the ripper tip 132 in angular terms corresponding to the mounting frame angle 150 and the shank axis angle 152.

In other possible embodiments, the ripper position sensors can include or use visual perception sensors 240 or machine vision technology such as LIDAR (light detection and ranging) or smart cameras. The visual perception sensors 240 can be configured to determine the current position and motion of the ripper 102 by processing a point cloud or visual image captured of the mounting member 136 and/or mounting frame 138 with respect to a background such as the terrain surface 104. The use of machine vision technology and image processing can supplement or replace the use of kinematic equations to determine the geometric position and motion of the ripper 102.

In other embodiments, the ripper configuration sensors can include one or more inertial measurement units (IMU) 242 operatively associated with the ripper 102. The IMU 242 can measure the applied forces caused by motion and/or acceleration of the device and can therefore determine its orientation and/or position. In an embodiment, the IMU 242 can be sensitive to magnetic fields to obtain orientation with respect the magnetic field of the Earth. The IMUs 242 can be physically attached at different defined locations of the mounting member 136 and/or mounting frame 138 to measure motion of those structures. The information obtained by the IMU 242 provides contextual reference and spatial associations about the physical arrangement and position of the ripper 102.

Another example of a ripper configuration sensor can be a force sensor 244 that is sensitive to physical forces applied to the ripper 102. When the ripper tip 132 impacts the terrain surface 104 or another object, reactive forces are transferred through the ripper shank 130, the mounting member 136 and the mounting frame 129 to the machine chassis 110. Similarly, actuation of the tilt actuator 144 and/or the lift actuator 148 applies forces to structural components of the ripper 102 causing motion and change in the spatial position thereof. The force sensors 244 can be a piezoelectric devices or strain gauges attached to the ripper shank 130 or the mounting frame 138 to measure deflection or distortion of those structures due to the applied forces. The force sensors 244 can also be fluid pressure sensors operative associated with the tilt and lift actuators 144, 148 measuring the fluid pressure therein, which may correspond with the forces transferred to or imparting geometric movement of the ripper 102.

To process the data received from the plurality of sensors and thereby assist in operation of the mobile machine 100 and particularly the ripper 102, the control system 200 can include an electronic controller 250. The electronic controller 250 can be a computerized and programmable device including hardware components and software programming capable of conducting logical operations on input data to produce a resulting output used in the operation of the mobile machine 100. Although illustrated as a single component, in different embodiments, the functionality of the electronic controller 250 can be distributed among a plurality of separate components.

The electronic controller 250 can include one or more microprocessors 252 for executing software instructions and processing computer readable data. Examples of suitable microprocessors include programmable logic devices such as field programmable gate arrays ("FPGA"), dedicated or customized logic devices such as application specific integrated circuits ("ASIC"), gate arrays, a complex programmable logic device, or any other suitable type of circuitry or microchip. To store application software and data, the electronic controller 250 can include a non-transitory computer readable and/or writeable data memory 254, for example, read only memory ("ROM"), random access memory ("RAM"), EEPROM memory, flash memory, or etc.

To interface and network with the other components of the control system 200 and other operational systems on the mobile machine 100, the electronic controller 250 can include an input/output interface 256 to electronically send and receive non-transitory data and information. The input/output interface 256 can be physically embodied as data ports, serial ports, parallel ports, USB ports, jacks, and the like to communicate via conductive wires, cables, optical fibers, or other communicative bus systems. Communication between the electronic controller 250 and the rest of the control system 200 can occur via any suitable communication protocol for data communication including sending and receiving digital or analog signals synchronously, asynchronously, or elsewise. For example, the input/output interface 256 can be communicatively connected and exchange data and information embodied as electronic signals or pulses with the plurality of sensors.

In an embodiment, to synchronize operations of the control system 200, the electronic controller 250 can include a timing device or counter 258. The counter 258 may be a timer or clock configured to measure the passage of time or may be a logic device that increments in response to the repeated occurrence of an event. The counter 258 can therefore operate in any suitable units such as time or clock cycles.

The electronic controller 250 can control aspects of a ripping operation including movement and geometric positioning of the ripper 102. For example, the electronic controller 250 can send data signals embodied as electrical pulses to control devices associated with the tilt and lift actuators 144, 146 causing actuation. Actuation may be specifically caused by the introduction of pressurized hydraulic fluid into or the removal of fluid from the hydraulic tilt and lift actuators 144, 146. The electronic controller 250 itself may be responding to commands issued either by an operator during manual operation or autonomously as part of an autonomous control system to move the ripper 102 accordingly.

The electronic controller 250 is also operatively situated to monitor the ongoing operation of the mobile machine 100 and ripping operation and can be configured to signal alerts or warnings when appropriate. Alerts may be signaled when an ongoing machine operation causes or is predicted to cause unintentional consequences, or when an error occurs during ongoing machine operations. In an embodiment, to signal the alert or warning, the control system 200 can be associated with an alarm device 260. The alarm device 260 can be a mechanism that provides a visual or an audible signal alerting others as to the cause or condition associated with the alarm. For example, the alarm device 260 can be a visual alarm 262 such as a light or plurality of lights that can be caused to flash so as to be conspicuous. The alarm device 260 may also be an audible alarm emitting a noise sufficient to draw attention and alert others. In an embodiment, the alarm 260 can be included with the visual display 206 corresponding to the HMI. In embodiments where the mobile machine is configured for autonomous operation, the alarm device 260 may send an electrical signal to the electronic controller 250 commanding it to undertake responsive actions to resolve the cause.

INDUSTRIAL APPLICABILITY

Figure 3:
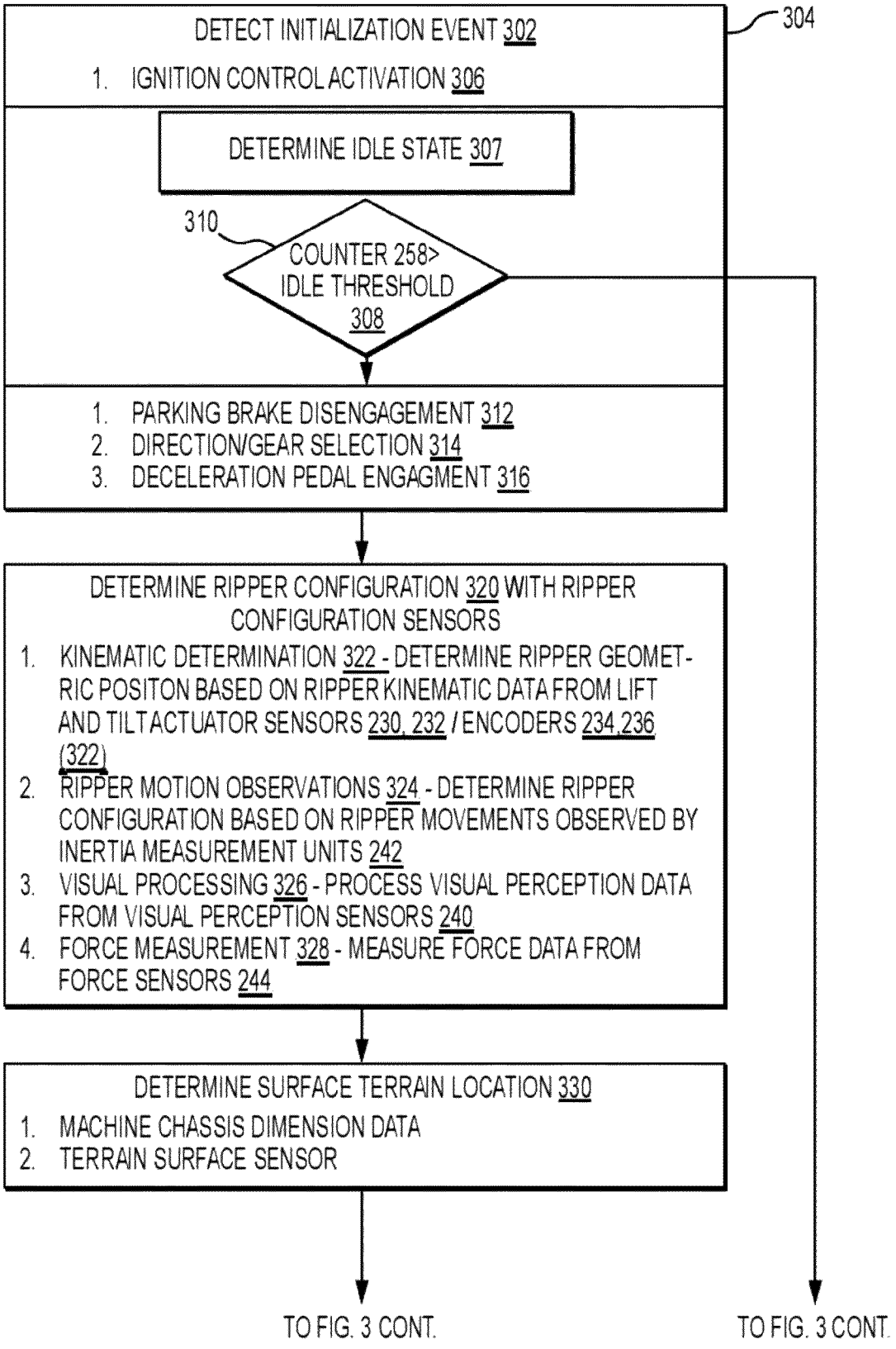
FIG. 3 is a flow diagram of a method controlling a ripping operation responsive, in part, to an initiation event and a ripper configuration, in accordance with some embodiments.
Figure 3:
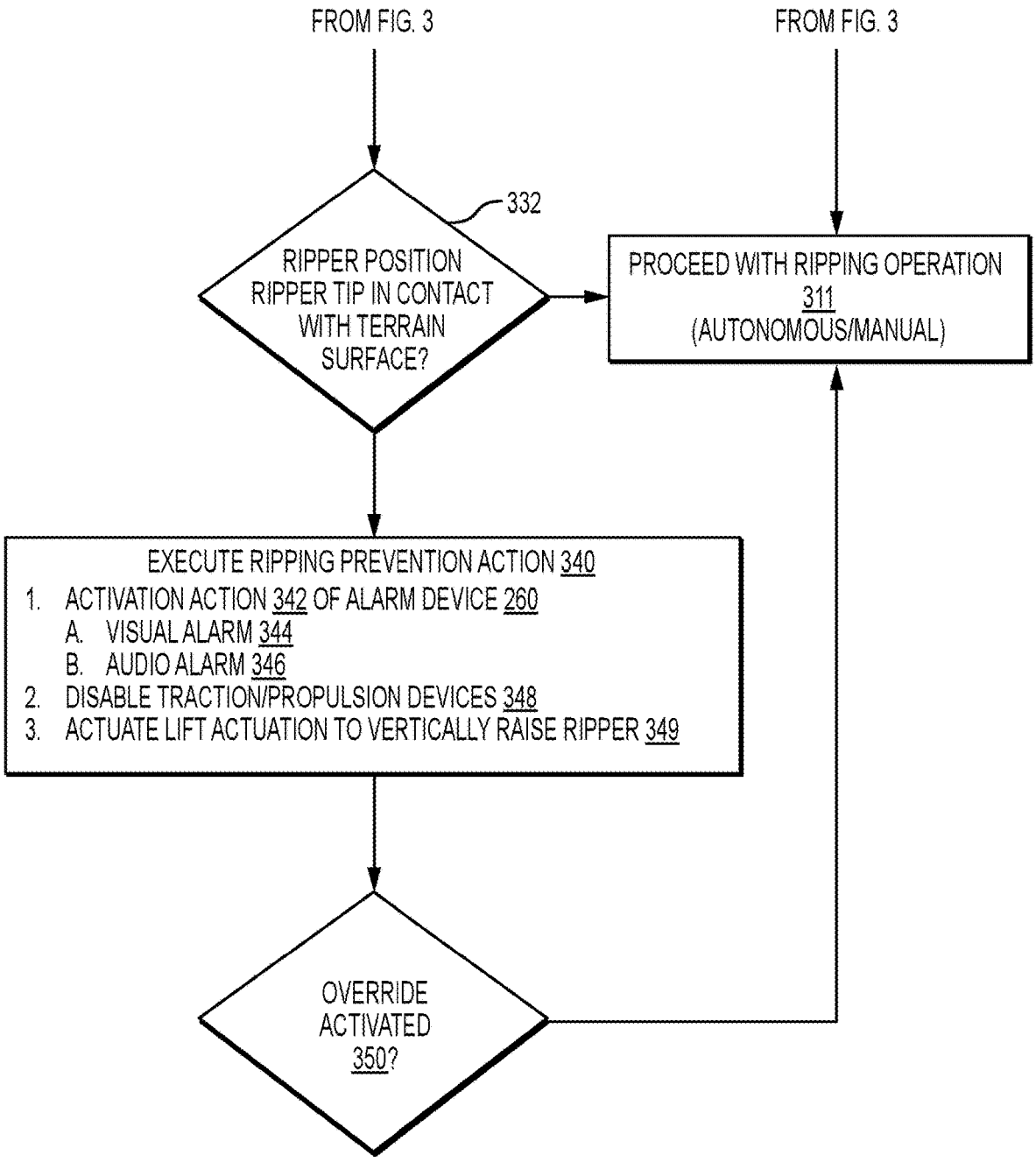

Referring to FIG. 3, with continued reference to the previous figures, there is illustrated an embodiment of an initiation process 300 or an automatic method by which the control system 200 is configured to prevent or reduce unintentional damage that may occur pursuant to a ripping operation. The initiation process 300 illustrated in FIG. 3 can be embodied as a computer readable program written as software in a suitable computer programming language and can be executed by the electronic controller 250 associated with the control system 200. In an embodiment, the initiation process 300 can be invoked by an initiation event 302 to determine whether the ripper tip 132 is in physical contact with the terrain surface 104 or another surface and to execute one or more actions to prevent the ripping operation from proceeding. The initiation process 300 can occur during fully autonomous operation of the mobile machine 100 or can occur to assist an operator during manual operation.

In either embodiment, the initiation process 300 can be embedded as part of the initiation routine or sequence for the mobile machine 100 and can be executed before travel or propulsion of the mobile machine 100 with respect to the terrain surface 104. Accordingly, the initiation process 300 can be invoked or activated in response to an initiation event 302 issued, for example, manually by an operator or autonomously to command travel or propelled movement of the mobile machine 100. The initiation event 302 is an instruction to the control system 200 causing it to responsively act by moving and causing travel of the mobile machine 100. The machine motion may be, for example, movement caused by the translation of traction/propulsion devices 114 with respect to the terrain surface 104. Another example of commanded machine movement may be associated with an excavator directed to swing an upper platform with respect to the lower carriage.

To detect occurrence of the initiation event 302, the initiation process 300 includes a detection process step 304. The detection process step 304 may recognize different initiation events 302 that necessarily occur prior to movement of the mobile machine 100. For example, the initiation event 302 can be an ignition keyswitch event or ignition control even 306. The ignition control may be key-operated switch or a pushbutton operatively associated with a control activation fob. The ignition control event 306 can cause the power source 112 to start running if the mobile machine 100 has been turned off.

Other initiation events 304 can occur if the power source 112 is running but has been idle for a period of time. The idle state 307 may refer to the operating conditions wherein the power source 112, for example, an internal combustion engine is running without being directly connected or delivering motive power to the traction/propulsion devices 114 or other significant loads. In the idle state 307, the power source 112 continues to operatively run without stalling but does not generate significant motive power or torque.

The counter 258 associated with the control system 200 can monitor the temporal duration in which the mobile machine 100 has been in the idle state 306 idle state 307, which can be measured in as a passage of time or in units such engine revolutions. To start the counter 258, the idle state, the control system 200 can be configured or programmed to recognize a specific event or occurrence. For example, the counter 258 may begin counting if operation of the power source 112 falls below predetermined running speed, or upon the absence of relative motion between the mobile machine 100 and the terrain surface 104, which may be determined by the ground sensor 210 and/or the GNSS system.

In an embodiment, the counter 258 can receive or can be programmed with an idle threshold 308, which may be a predetermined measurement signifying the mobile machine 100 is likely in the idle state. The idle threshold 308 may be adjustable and can be entered by an operator using, for example, the visual display 206. According to the initiation process 300, a comparison decision 310 is conducted between the counter 258 and the idle threshold 308. In the event the active count of the counter 258 meets or exceeds the idle threshold 308, the control system 200 can be operatively configured to recognize any detected input commands as corresponding to an initiation event 302. Prior to expiration of the idle threshold 308, the control system 200 can be generally unresponsive to the initiation events 354 because, for example, the mobile machine 100 may only be momentarily paused during operation. The initiation process 300 can therefore terminate and the control system 300 can proceed with the ripping operation 311.

If the mobile machine 100 is determined to be in the idle state 307, the initiation event 302 responsible for triggering the initiation process 300 and detectable by the control system 200 can correspond to some command or direction to operatively engage the drivetrain, such as brake disengagement event 312 in which the parking brake 128 is disengage allowing power transfer through the drivetrain. Another example includes a gear selection event 314 in which the drive selector 126 is manipulated to place the drivetrain into an operative gear, or to establish the travel direction 118 in forward or reverse. Another example includes pedal actuation event 316 to release or depress the deceleration pedal 122 adjusting fluid or airflow to the power source 112.

Upon occurrence and recognition of an initiation event 302, the initiation process 300 can conduct an operation to determine the ripper configuration, referred to as a ripper configuration determination 320. The ripper configuration determination 320 determines the geometric and spatial arrangement of the ripper 102 with respect to a reference, for example, the machine chassis 110, and then determines whether the ripper tip 132 is in physical contact with the terrain surface 104 or another support surface on which the ripper 102 may be resting.

For example, if the geometric arrangement of the ripper 102 corresponds with the stowed position 154, the initiation process 300 can assume the ripper tip 132 is in contact with the terrain surface 104. Alternatively, the ripper configuration determination 320 may measure the geometric arrangement and spatial position of the ripper tip 132 and the location of the terrain surface 104 and compare the measurements to determine if the ripper tip 132 and the terrain surface 104 coincide in location.

For example, the ripper configuration determination 320 can include a kinematic determination 322 in which the kinematic data is obtained from the tilt and lift actuator sensors 230, 232 and/or the tilt and lift encoders 234, 236. In response to receiving kinematic data, the electronic controller 250 can obtain machine dimensional data, which may include the geometric dimensions of the machine chassis 110, the ripper shank 130, the mounting member 136, and the mounting frame 138, which may be predefined numerical values that stored in the memory 254 associated with the electronic controller 250. The electronic controller 250 can apply kinematic formulas and equations and use the processor 252 to calculate, generally, the geometric arrangement of the ripper 102, and specifically the position of the ripper tip 132 with respect to the terrain surface 104.

In another example, the ripper configuration determination 320 can include a ripper motion observation 324 in which past or historic motion data collected by the IMU's 242 and stored in, for example, the memory 254 of electronic controller 250. The processor 252 can analyze and process the historic data of the ripper movements to estimate the current geometric arrangement and the position of the ripper tip 132 including whether in it contacts the terrain surface 104.

Instead of kinematics data, the ripper configuration determination 320 can use other information to determine the ripper configuration and whether the ripper tip 132 contacts the terrain surface 104 or other support surface. For, example, in a visual processing step 326, the visual perception sensor 240 can capture visual data embodied as an image file or a point cloud and can use machine vision techniques and visual imagining processing to recognize the geometric arrangement or spatial configuration of the ripper 102.

In another example, the ripper configuration determination 320 includes a force measurement step 328 that can use data from the force sensors 244 to measure and determine a normal force applied to the ripper tip 132. In particular, if the ripper 102 is configured in the stowed position 154 with the ripper tip 132 contacting the terrain surface 104 or a similar support surface, a resulting and measurable normal force can be transferred through the ripper shank 130 and mounting member 136 to the mounting frame 138. The force sensors 244 can be sensitive to measure structural distortions and deflections caused by the applied normal forces, which may be of a magnitude sufficient to indicate abutting contact between the ripper tip 132 and terrain surface 104. The use of force sensors 244 to determine the ripper configuration occurs without regard to the geometric arrangement of the ripper 102 and without relying on kinematic or dimensional data.

Because the resulting determination of the position of the ripper tip 132 from the kinematic determination 322 must be compared with a known location of the terrain surface 104 or other support surface, the initiation process 300 may operatively make a terrain determination 330 establishing the spatial location of the terrain surface 104 or other support surface. The terrain determination 330 can be made using the ground sensor 210 and/or the predefined dimension of the machine chassis 110.

In a contact decision step 332, the control strategy 200 pursuant to the initiation process 300 decides whether the ripper tip 132 contacts the terrain surface 104 and/or other support surface. The contact decision step 332 can be a straightforward comparison between the ripper position and the spatial location of the terrain surface 104 found in the terrain determination 330. The contact decision 332 can also be a direct determination without comparative logic, for example, an examination based directly on the visual data captured by the visual perception device 240 in the visual processing step 326 or the normal force sensed in the force measurement step 328. In the event the contact decision 332 finds that the ripper tip 132 and the terrain surface 104 are not in contact, the initiation process 300 can terminate and the mobile machine 100 can proceed with the ripping operation 311 either manually or autonomously.

If the ripper tip 132 is in contact with the terrain surface 104 or another support surface, the control system 200 in accordance with the initiation process 300 can responsively execute one or more actions to prevent the mobile machine 100 from proceeding, autonomously or under manual supervision, with a ripping operation. The control strategy 200 can conduct or cause the prevention action 340 as part of the initiation process 300. The prevention actions 340 are intended to prevent, directly or indirectly, the ripper operation from proceeding.

For example, the prevention action 340 can include an alarm activation action 342 that occurs in which the control strategy 200 activates the alarm device 260 intended to alert an operator that the ripper configuration is such that the ripper tip 132 is likely in contact with the terrain surface 104. The alarm activation action 342 can utilize one or more of a visual alarm 344 or an audio alarm 346 to signal an alert about the ripper configuration.

As another example, to securely prevent the ripping operation from occurring, the prevention action 340 can correspond to a disablement action 348 in which the traction/propulsion devices 114, for example, are disabled. The disablement action 348 can be accomplished by, for example, disabling the drivetrain to decouple the power source 112 and traction/propulsion devices 114 preventing the transfer of motive power. The disablement action 348 may also prevent the power source 112 from being activated, or may deactivate the power source if already on and in the idle state 307.

As another example, the control strategy 200 can positively maneuver and move the ripper 102 out of contact with the terrain surface 104 prior to the occurrence of the ripping operation or travel of the mobile machine 100. In an autolift operation 349, for example, The electronic controller 250 can send electrical signals to the appropriate controls to cause the tilt and lift actuators 144, 148 to actuate in a manner that vertically raises the ripper tip 132 from the terrain surface 104, and the control system 200 can time the autolift operation 349 to occur before enable or allowing other motion of the mobile machine 100.

It may be the case that the prevention action 340 is unintended and it is instead desired that the mobile machine 100 proceed with the ripping operation, either autonomously or pursuant to manual operation. Upon such an occurrence, the initiation process 300 can include or involve an override function initiated by an override action 350. For example, the override action 350 can be activated through one of the user interface controls such as those on the visual display 206 or by toggling the automatic setting switch 208 associated with the operational mode detector 224. Further, if the mobile machine 100 is manually operated, the override action 350 may occur in response to continued manipulation of the operator controls such as the deceleration pedal 122, the steering control 124, and/or ripper control 202 indicating the operator intends to maintain control over the operation of the mobile machine. When activated, the override action 350 can override and cease any previously activated prevention actions 340. The override action 350 can be instigated if the operator intends to begin the ripping operation with the ripper tip 132 in contact with the terrain surface 104. In the event the initiation process 300 is terminated by the override action 350, the mobile machine can proceed with the ripping operation 311.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

The use of the terms "a" and "an" and "the" and "at least one" or the term "one or more," and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B" or one or more of A and B") is to be construed to mean one item selected from the listed items (A or B) or any combination of two or more of the listed items (A and B), unless otherwise indicated herein or clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

We claim:

1. A control system for a mobile machine comprising:

an initiation detector configured to detect an initiation event prior to travel of the mobile machine;

a ripper configuration sensor associated with a ripper attached to the mobile machine; and an electronic controller in communication with the initiation detector and with the ripper configuration sensor, the electronic controller configured, based on detecting the initiation event, to determine whether a ripper tip attached to the ripper contacts a support surface, and cause, based on determining that the ripper tip is contacting the support surface, a ripping prevention action prior to travel of the mobile machine, wherein the electronic controller includes a counter, and the electronic controller is not responsive to the initiation event prior to expiration of an idle threshold of a power source of the mobile machine measured by the counter.

2. The control system of claim 1, wherein the initiation detector is associated with an ignition control of the mobile machine and the initiation event is an occurrence of switching on the ignition control.

3. The control system of claim 1, wherein the initiation detector is associated with a drive selector of the mobile machine and the initiation event is selection of a drive gear.

4. The control system of claim 1, wherein the initiation detector is associated with a parking brake, and the initiation event is a disengagement of the parking brake.

5. The control system of claim 1, wherein the ripping prevention action includes activating an alarm device that causes an alert indicating that the ripper tip contacts the support surface.

6. The control system of claim 1, further comprising an override feature ceasing the ripping prevention action when activated.

7. The control system of claim 1, wherein the ripping prevention action includes actuating one or more of a tilt actuator or a lift actuator to vertically raise the ripper with respect to the support surface.

8. The control system of claim 1, wherein the ripper configuration sensor is associated with one or more of a tilt actuator or a lift actuator and provides kinematic ripper data to the electronic controller and wherein the electronic controller is further configured to determine whether the ripper tip contacts the support surface based on the kinematic ripper data.

9. The control system of claim 1, wherein the ripper configuration sensor is a visual perception sensor configured to capture visual perception data about the ripper.

10. The control system of claim 1, wherein the ripper configuration sensor is a force sensor configured to sense a normal force applied to the ripper tip.

11. A method of controlling a mobile machine comprising:

detecting an initiation event prior to travel of the mobile machine;

sensing, by a ripper configuration sensor, a ripper configuration of a ripper attached to the mobile machine;

determining, after detecting the initiation event and based on the ripper configuration, whether a ripper tip that is attached to a ripper shank of the ripper contacts a support surface;

causing a ripping prevention action prior to travel of the mobile machine;

comparing an output of a counter with an idle threshold of a power source of the mobile machine; and delaying the detecting the initiation event until expiration of the idle threshold.

12. The method of claim 11, wherein the initiation event is selected from one or more of switching an ignition control, disengaging a parking brake, or selecting a drive gear.

13. The method of claim 11, wherein executing the ripping prevention action include activating an alarm device that causes an alert indicating that the ripper tip contacts the support surface.

14. The method of claim 11, wherein the ripper configuration sensor is associated with one or more of a tilt actuator or a lift actuator and wherein the ripper configuration is determined based in part on kinematic ripper data obtained from the one or more of the tilt actuator or the lift actuator.

15. The method of claim 11, wherein the ripper configuration sensor is one or more of a visual perception sensor or a force sensor.

16. A mobile machine comprising:

a machine chassis supported on a plurality of traction devices for traveling over a terrain surface in a travel direction;

an initiation detector configured to detect an initiation event prior to travel of the mobile machine;

a ripper attached to the machine chassis and including a ripper shank and a ripper tip, at a distal end of the ripper shank, for penetrating the terrain surface;

a ripper configuration sensor associated with the ripper and configured to sense whether the ripper tip contacts the terrain surface; and an electronic controller in communication with the initiation detector and with the ripper configuration sensor, the electronic controller configured to determine whether the ripper tip contacts the terrain surface and cause, based on determining that the ripper tip contacts the terrain surface, a ripping prevention action prior to travel of the mobile machine, wherein the electronic controller includes a counter, and the electronic controller is not responsive to the initiation event prior to expiration of an idle threshold of a power source of the mobile machine measured by the counter.

17. The mobile machine of claim 16, wherein the initiation event is associated with one or more of switching on an ignition control, selecting a drive gear with a drive selector, or disengaging a parking brake.

18. The mobile machine of claim 16, wherein the ripper configuration sensor is one or more of:

an actuator sensor configured to obtain kinematic ripper data from one of a tilt actuator or a lift actuator;

a visual perception sensor configured to capture visual perception data about the ripper; or a force sensor configured to determine a normal force applied to the ripper tip by the terrain surface.

* * * * *